US006105292A

United States Patent [19]

Current

[11] Patent Number: 6,105,292

[45] **Date of Patent: *Aug. 22, 2000**

[54] MODULAR DISPLAY SIGN

[75] Inventor: Wayne Current, Holmdel, N.J.

[73] Assignee: International Visual Corporation, Port Washington, N.Y.

[ * ] Notice: This patent is subject to a terminal disclaimer.

[21] Appl. No.: 09/232,890

[22] Filed: Jan. 15, 1999

Related U.S. Application Data

[63] Continuation-in-part of application No. 09/113,919, Jul. 10, 1998, Pat. No. 6,009,651.

[51] Int. Cl.[7] ..... G09F 7/00; G09F 15/00

[52] U.S. Cl. ..... 40/605; 40/606; 40/610; 40/611

[58] Field of Search ..... 40/605, 606, 610, 40/611, 491

[56] References Cited

U.S. PATENT DOCUMENTS

| | | | |
|---|---|---|---|
| 758,088 | 4/1904 | Mixer | 40/611 |
| 1,862,776 | 6/1932 | Timberlake | 40/605 X |
| 1,909,651 | 5/1933 | Bower | 40/606 |
| 4,329,800 | 5/1982 | Shuman | 40/606 |
| 5,377,434 | 1/1995 | Wilson | 40/611 |
| 5,664,749 | 9/1997 | Kump et al. . | |
| 5,701,695 | 12/1997 | Current . | |
| 5,906,064 | 5/1999 | Field | 40/606 |
| 6,009,651 | 1/2000 | Current | 40/605 |

*Primary Examiner*—Terry Lee Melius
*Assistant Examiner*—Rodrigo J. Morales
*Attorney, Agent, or Firm*—Collard & Roe, P.C.

[57] ABSTRACT

A modular display sign having a base section with a base support rail secured to the base section. A first display section is removably attached to the base support rail in a plane perpendicular to the base section. At least one second display section is removably attached to the first display section in a plane perpendicular to the base section. This arrangement enables the vertical stacking of display sections thereby increasing the display area and adjusting the height of the display sign.

5 Claims, 5 Drawing Sheets

MODULAR DISPLAY SIGN

This is a continuation-in-part of application Ser. No. 09/113,919, filed Jul. 10, 1998, now U.S. Pat. No. 6,009,651.

BACKGROUND OF THE INVENTION

1. Field of the Invention

The present invention relates to sign holders. More particularly, the present invention relates to a modular display sign which may be adjusted to display several signs in a vertical column.

2. The Prior Art

Many prior art display devices are non-adjustable and are manufactured as integral units with fixed heights and framed areas.

The prior art discloses certain attempts to provide adjustable display devices, for example, U.S. Pat. No. 5,701,695. While the '695 patent overcomes certain problems, namely the ability to adjust the heights of the display, it still has numerous drawbacks. For example, when the display frame is extended to its full upright position, no messages may be displayed in the area closest to the base. Therefore, it would be desirable to provide a modular display sign which would allow several display sections to be stacked on top of each other thereby allowing adjustable height with an increase in display area.

SUMMARY OF THE INVENTION

It is therefore an object of the present invention to overcome the drawbacks of the prior art and to provide a modular display sign system which is simply and easily manufactured.

It is a further object of the present invention to provide a modular display sign which is capable of expanding, in the vertical direction, to any number of display sections.

It is the final object of the present invention to provide a modular display sign which allows the insertion or removal of a sign, from any display section, with minimal effort.

These and other related objects are achieved according to the invention by a plurality of display sections removably attached to each other and removably attached to a base section. The base section can have any shape. A base support rail is secured to the base section. A first U-shaped display section is removably attached to the base support rail. The display section and the base section intersect to form a right angle. A slot is milled vertically along one side of each display section so that a sign may be inserted or removed for display.

A second U-shaped display section may then be removably attached to the first U-shaped display section. Continuing in this manner, any number of U-shaped display sections may be attached to each other extending in a vertical direction. This configuration allows great flexibility in determining the height of the display sign as well as the number of display sections viewable.

In an alternative embodiment, the first section that is attached to the base is square and includes a support rail at the bottom of the first section. The base itself does not have a support rail. Additional U-shaped sections are then mounted on top of the first square section.

Additional details of the invention are contained in the following detailed description and the attached drawings, in which the preferred embodiment is illustrated by way of example.

BRIEF DESCRIPTION OF THE DRAWINGS

Other objects and features of the present invention become apparent from the following detailed description considered in connection with the accompanying drawings which disclose the embodiment of the present invention. It should be understood, however, that the drawings are designed for the purpose of illustration only not as a definition of the limits of the invention.

In the drawings, wherein similar reference characters denote similar elements throughout the several views.

DETAILED DESCRIPTION OF PREFERRED EMBODIMENTS

Figure 1:
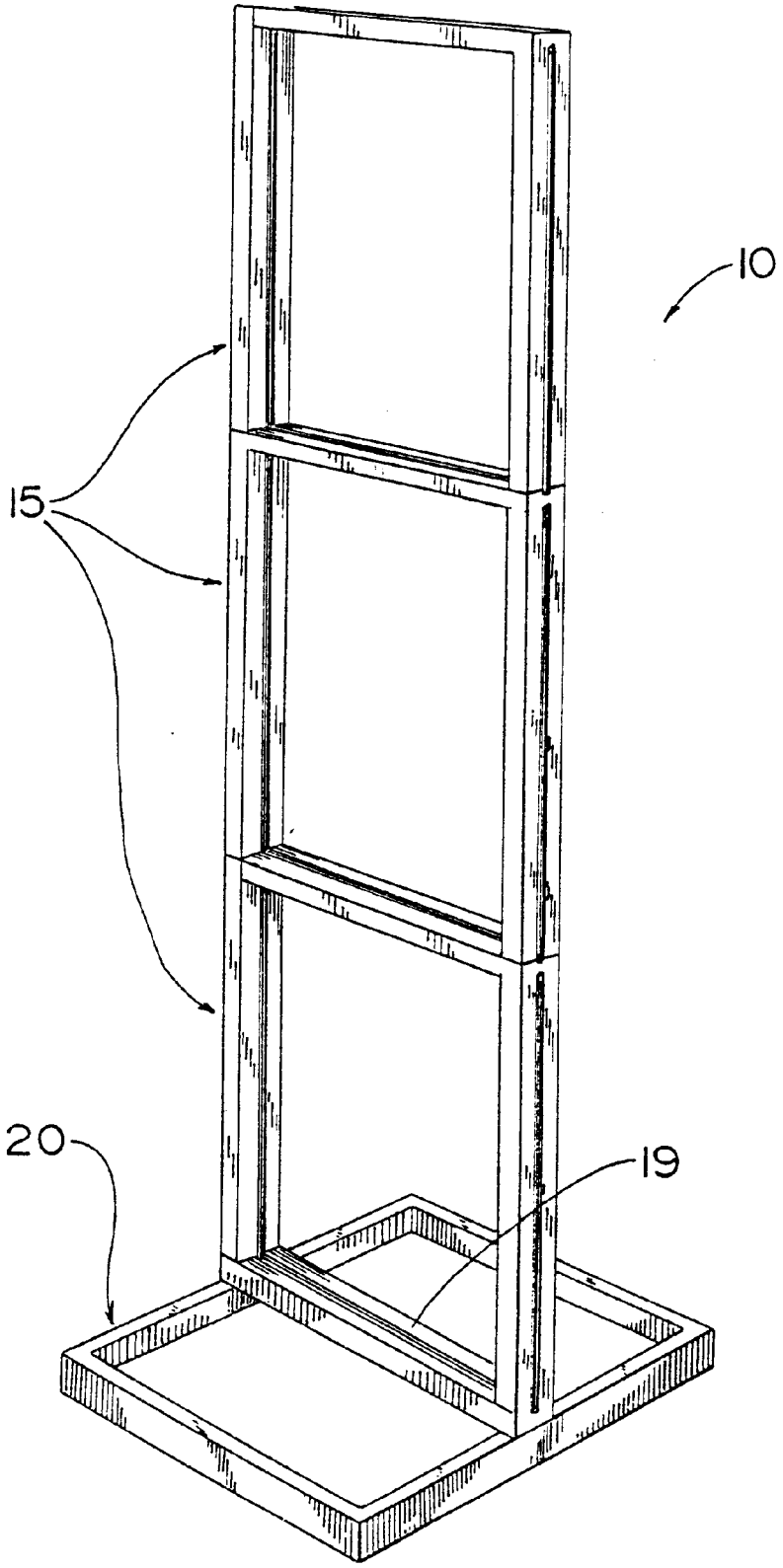
FIG. 1 is a perspective view of a modular display sign according to the invention.

Turning now in detail to the drawings, FIG. 1 shows a modular display sign 10 comprising a plurality of display sections 15 removably connected to each other and removably connected to a base support rail 19. Base support rail 19 is secured to a base section 20. Base section 20 may have any shape or size.

Figure 2:
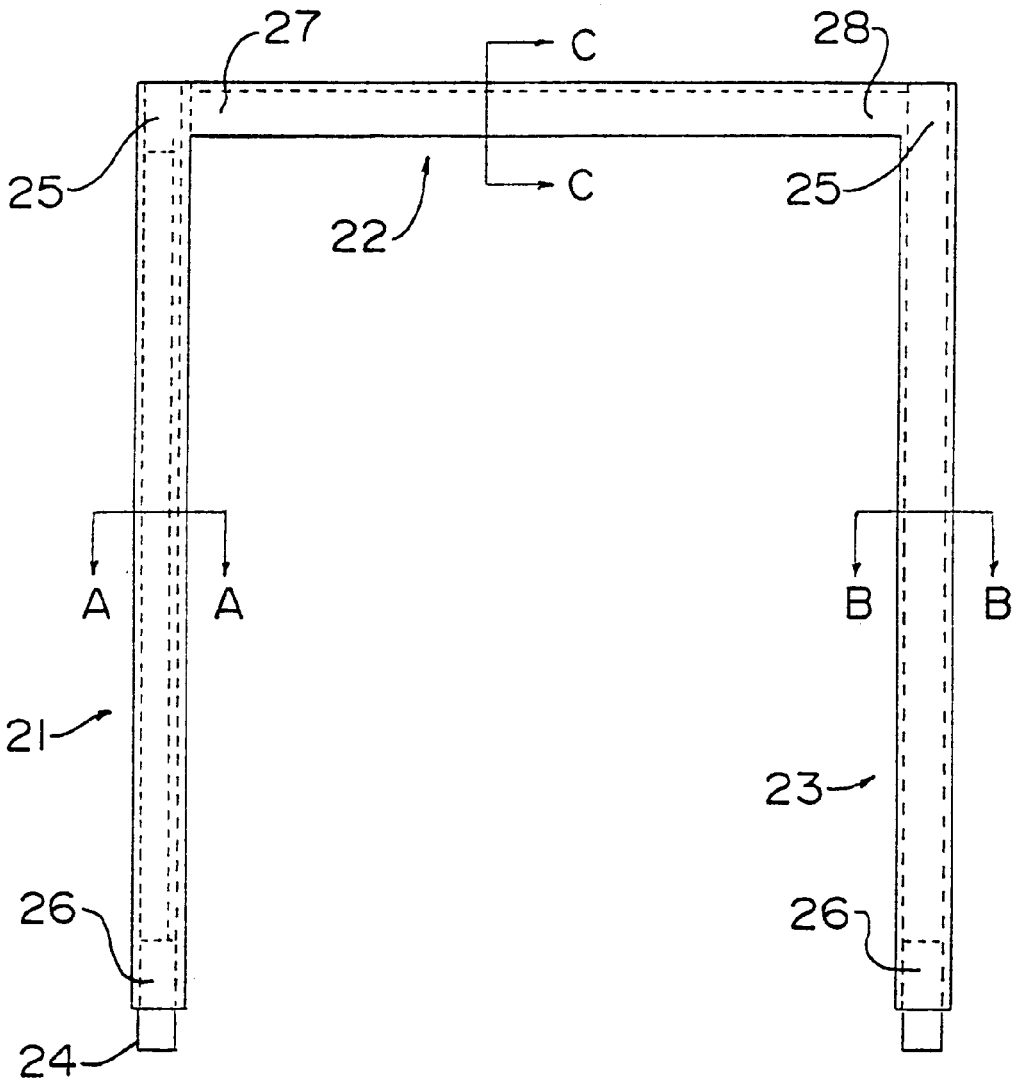
FIG. 2 is a front plan view of one display section.

Referring to FIG. 2, display section 15 further comprises three rail sections: a left rail 21, a top rail 22, and a right rail 23. Left rail 21 and right rail 23 each have a top end and a connection end 26. Top rail 22 has a left end 27 and a right end 28 and cutout 25. Top end of left rail 21 and right rail 23 are secured perpendicular to left end 27 and right end 28 of top rail 22. The connection ends 26 of left rail 21 and right rail 23, which are opposite rail 22, contain a connection block 24, welded in place. The display sections may be made of chrome plated steel or some other suitable material.

Figure 3A:
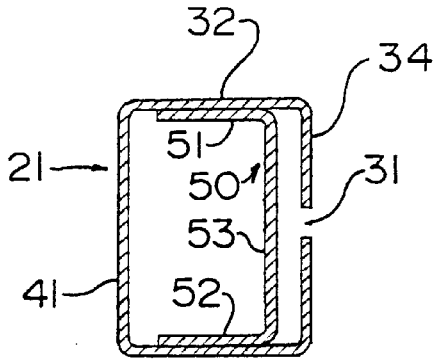
FIG. 3*a* is a cross sectional view taken along the line a—a, from FIG. 2.

Referring to FIG. 3*a,* there is shown a cross sectional view of left rail 21 taken along the line a—a. Left rail 21 further comprises a back side 32, a front side 33, an exterior side 41, and an interior side 34.

A first U-shaped interior channel or rail 50 is located within left rail 21, and comprises a left side 51, a right side 52, and a top side 53. Left side 51 and right side 52 of U-shaped interior channel 50 are fixedly attached to back side 32 and front side 33 respectively, of left rail 21. Interior channel 50 is secured within left rail 21 so as to create a space between top side 53 and interior side 34. According to the present invention, this space should be 9/32 of an inch, however this space may be varied to accommodate any desired space.

A slot opening 31 is created in interior side 34. Slot opening 31 extends from top end 25 to connection end 26 on interior side 34 of left rail 21. Slot opening 31 receives a display sign (not shown) which rests against top side 53 of interior channel 50.

Figure 3B:
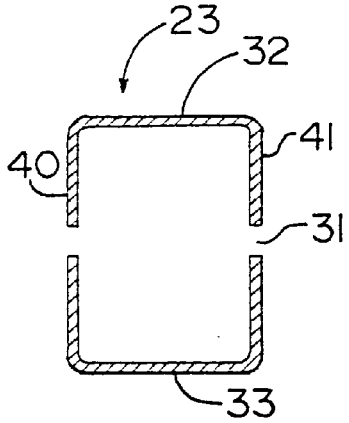
FIG. 3*b* is a cross sectional view taken along line b—b, from FIG. 2.

Referring to FIG. 3*b,* there is shown a cross sectional view of right rail 23 taken along line b—b. Right rail 23 comprises an interior side 40, an exterior side 41, a back side 32 and a front side 33. A slot opening 31 is formed from top end 25 to connection end 26 along exterior side 41 and interior side 40. Slot opening 31 accepts a display sign (not shown).

Figure 3C:
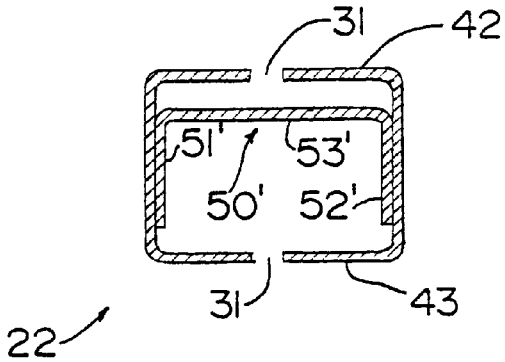
FIG. 3*c* is a cross sectional view taken along the line c—c, from FIG. 2.

Referring to FIG. 3*c,* there is shown a cross sectional view of top rail 22 taken along the line c—c. Top rail 22 comprises a top side 42 and a bottom side 43. Located within top rail 22 is a second U-shaped interior channel 50'. Interior channel 50' is secured within top rail 22 so as to create a space between top side 42 and top side 53' of interior channel 50'. According to the present invention, this space should be approximately 9/32 of an inch. However, it is to be understood that one may modify the location of interior channel 50' to create any sized space. Slot opening 31 is located along top side 42. Slot opening 31 is designed to accept a display sign (not shown). Slot opening 31 along top side 42 forms the base of the display sign (not shown). Slot opening 31 along bottom side 43 receives the top of the next display sign (not shown).

Figure 4:
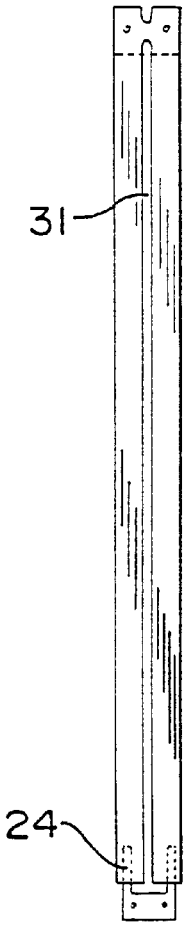
FIG. 4 is a side plan view of a display section.

Referring to FIG. 4, there is shown a side view of display section 15. Slot opening 31 extends vertically the length of display section 15. Connection block 24 is located within connection end 26 of left rail 21 and right rail 23 opposite top rail 22.

Figure 5:
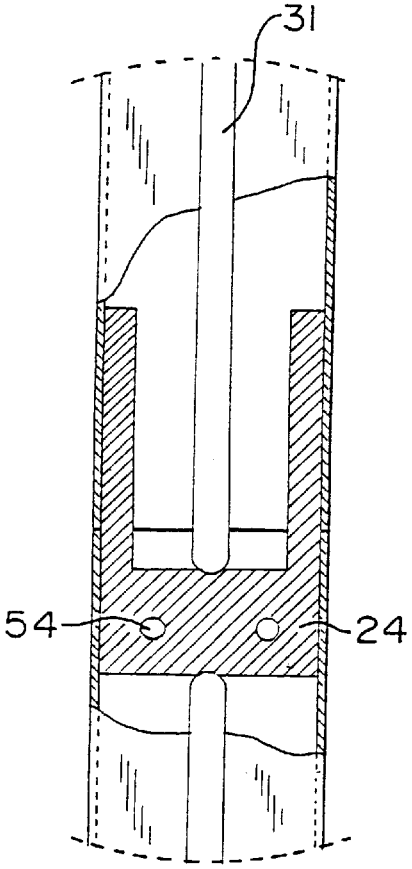
FIG. 5 is an enlarged view of a connection block.

Referring to FIG. 5, connection block 24 is comprised of a U-shaped piece of metal or other suitable material, which is secured within connection end 26 of left rail 21 and right rail 23. Connection block 24, which protrudes out of connection ends 26 of left rail 21 and right rail 23 located opposite top rail 22. Connection block 24, which protrudes outside of left rail 21 and right rail 23, is inserted into a corresponding opening located in top rail 22. A pair of screw holes 54 are located on top rail 22. Screws may be inserted through screw hole 54 which engage connection block 24 thereby removably attaching left rail 21 and right rail 23 of display section 15 to the top rail 22 of the next display section 15 or base support rail 19.

Figure 6A:
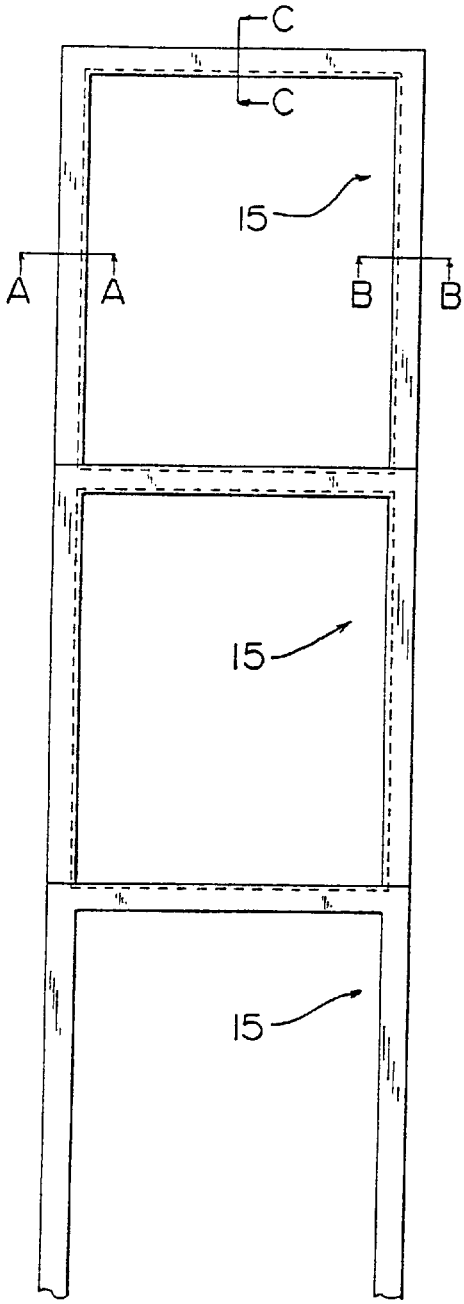
FIG. 6*a* is a plan view of several display sections removably connected to each other.
Figure 6B:
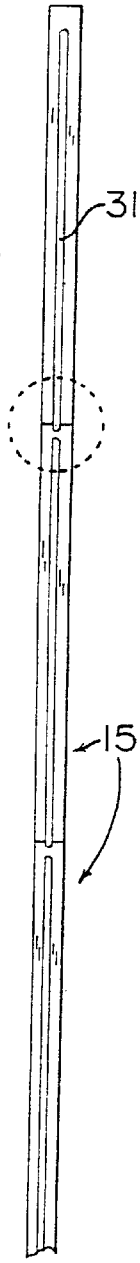
FIG. 6*b* is a side view of embodiment shown in FIG. 6*a;*.

Referring to FIG. 6*a,* several display sections 15 are removably connected to each other to form a modular display sign 10.

Referring to 6*b,* slot opening 31 runs vertically along exterior side 41 of right rail 23. A display sign (not shown) may be inserted within slot opening 31. Slot opening 31 provides easy access to insert or remove a display sign.

Figure 7:
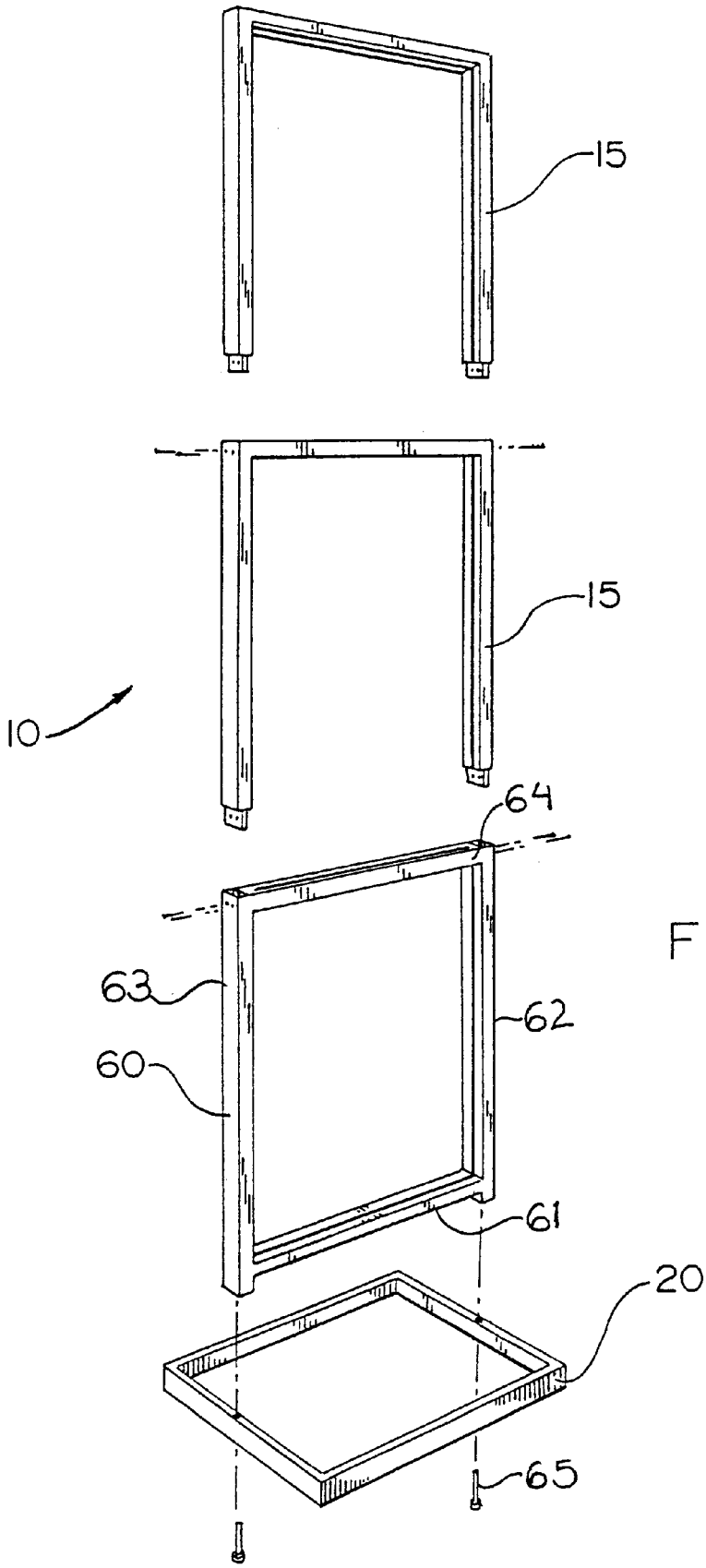
FIG. 7 is an exploded view of an alternative embodiment of the invention.

An alternative embodiment of the invention is shown in FIG. 7. In this embodiment, modular display sign 10 comprises a plurality of U-shaped display sections 15 removably connected to each other and removably connected to a display section 60. Display section 60 is secured to base section 20. Base section 20 may have any shape or size. This embodiment is similar to the first embodiment described, except that support rail 19 not present, and instead there is a bottom rail 61 connecting the left and right rails 62, 63 which are also connected to top rail 64 to form a rectangular display section 60. Left rail 62, right rail 63 and top rail 64 are all formed and connected similar to the rails in U-shaped sections 15, described above. The only difference is the connection of bottom rail 61 near the connection ends of left and right rails 62 and 63. Display section 60 is secured to base section 20 via screws 65.

While only a few embodiments of the present invention has been shown and described, it is to be understood that many changes and modifications may be made thereunto without departing from the spirit and scope of the invention as defined in the appended claims.

What it is claimed:

1. A modular display sign comprising;

a base section having a base support rail secured to said base section;

a first display section removably attached to said base support rail, wherein said display section lies in a plane perpendicular to said base section, said first display section having a bottom support portion in a plane parallel to said base section; and at least one additional display section removably attached to said first display section, wherein said at least one additional display section lies in a plane perpendicular to said base section and said additional display section comprises:

a top rail having a left end and a right end, and said additional display section further comprises a U-shaped rail disposed and secured within said top rail, wherein said U-shaped rail is located at an appropriate distance so as to support a display sign;

a left rail having a top end and a connection end; and a right rail having a top end and a connection end, wherein said top ends of said left and said right rails are fixedly attached to said left end and said right end, respectively, of said top rail at 90° angles, forming a U-shaped device.

2. The modular display sign according to claim 1, wherein said right rail contains a pair of slots on opposite sides of said rail extending from said top end to said connection end for receiving a display sign.

3. The modular display sign according to claim 1, wherein said first display section and said at least one additional display section are made of chrome plated steel.

4. The modular display sign according to claim 1, wherein said top rail further comprises:

a cutout disposed on said right end and said left end, wherein said cutout is specifically sized as to receive and secure, perpendicular to said top rail, an additional U-shaped display section.

5. The display sign according to claim 1, wherein the first display section comprises:

a top rail having a left end and a right end;

a left rail having a top end and a connection end;

a right rail having a top end and a connection end; and a bottom rail having a left end and a right end, wherein said top ends of said left and said right rails are fixedly attached to said left end and said right end, respectively, of said top rail at 90° angles, and wherein said left and right ends of said bottom rail is connected to the left and right rails near the connection end of said left and right rails, respectively, forming a substantially rectangular device.

* * * * *